United States Patent [19]

Kuzuya et al.

[11] Patent Number: 4,715,735

[45] Date of Patent: Dec. 29, 1987

[54] DUAL MODE PRINTING APPARATUS WITH MULTIPLE PRINT RIBBON CASSETTES

[75] Inventors: Susumu Kuzuya; Mamoru Imaizumi, both of Nagoya, Japan

[73] Assignee: Brother Kogyo Kabushiki Kaisha, Aichi, Japan

[21] Appl. No.: 664,339

[22] Filed: Oct. 24, 1984

[30] Foreign Application Priority Data

| | | | |
|---|---|---|---|
| Oct. 31, 1983 | [JP] | Japan | 58-204357 |
| Oct. 31, 1983 | [JP] | Japan | 58-204358 |
| Oct. 31, 1983 | [JP] | Japan | 58-204359 |
| Oct. 31, 1983 | [JP] | Japan | 58-204360 |

[51] Int. Cl.[4] ..... B41J 3/54; B41J 35/28

[52] U.S. Cl. ..... 400/82; 400/208; 400/229

[58] Field of Search ..... 400/82, 196, 196.1, 400/207, 208, 208.1, 212, 223, 224.1, 225, 229, 231, 185, 144.2

[56] References Cited

U.S. PATENT DOCUMENTS

| | | | |
|---|---|---|---|
| 3,185,823 | 5/1965 | Ellersick, Jr. et al. | 235/310 |
| 3,576,582 | 4/1971 | Smith, Jr. | 346/61 |
| 4,025,830 | 5/1977 | Delaporte | 318/6 |
| 4,026,403 | 5/1977 | Inose et al. | 400/144.2 |
| 4,204,779 | 5/1980 | Lee et al. | 400/82 |
| 4,281,938 | 8/1981 | Phillips | 400/171 |
| 4,376,585 | 3/1983 | Fromme et al. | 400/185 |
| 4,389,126 | 6/1983 | Honma et al. | 400/82 |
| 4,444,519 | 4/1984 | Howell et al. | 400/82 |
| 4,453,167 | 6/1984 | Moroyshi | 400/697 |
| 4,462,707 | 7/1984 | Falconieri | 400/225 |
| 4,469,459 | 9/1984 | Trezise et al. | 400/208 |
| 4,472,073 | 9/1984 | Valle et al. | 400/208 |
| 4,527,918 | 7/1985 | Yamamoto et al. | 400/82 |
| 4,595,303 | 6/1986 | Kuzuya et al. | 400/82 |

FOREIGN PATENT DOCUMENTS

| | | | |
|---|---|---|---|
| 11721 | 11/1980 | European Pat. Off. . | |
| 22397 | 1/1981 | European Pat. Off. | 400/82 |
| 3104351 | 9/1982 | Fed. Rep. of Germany | 400/82 |
| 54-156725 | 12/1979 | Japan | 400/82 |
| 56-4462 | 1/1981 | Japan | 400/82 |
| 56-5775 | 1/1981 | Japan | 400/82 |
| 58-124687 | 7/1983 | Japan | 400/208 |
| 58-128859 | 8/1983 | Japan | 400/82 |
| 58-171986 | 10/1983 | Japan | 400/208 |

OTHER PUBLICATIONS

Greenlief, G. L. et al.; *IBM Tech Disc Bull;* vol. 26, No. 3B, pp. 1580–1582; Aug. 1983; "Variable Life & Feed Increment Ribbon/Correction Mechanism".

*IBM Technical Disclosure Bulletin,* D. J. Moore, et al., vol 22, No. 5, Oct. 1979, pp. 1754–1755.

*IBM Technical Disclosure Bulletin,* J. G. Barnes, et al., vol. 26, No. 8, Jan. 1984, pp. 4370–4371.

*IBM Technical Disclosure Bulletin,* R. T. Sha, et al., vol. 27, No. 1B, Jun. 1984, pp. 841–843.

*Primary Examiner*—Charles A. Pearson
*Assistant Examiner*—David A. Wiecking
*Attorney, Agent, or Firm*—Parkhurst & Oliff

[57] ABSTRACT

A printing apparatus having a carrier which reciprocates along a print line defined on a platen, comprising a first printing assembly supported on the carrier and having type elements abuttable on the platen for printing characters, and a second printing assembly supported on the carrier for printing characters by a dot matrix. The first and second printing assemblies have a first and second print point, respectively, which are spaced from each other in a direction parallel or perpendicular to the print line. Each print assembly has its own ribbon cassette; one is parallel to the print line and one is perpendicular to the print line.

5 Claims, 16 Drawing Figures

DUAL MODE PRINTING APPARATUS WITH MULTIPLE PRINT RIBBON CASSETTES

BACKGROUND OF THE INVENTION

The present invention relates to a printing apparatus which allows two modes of printing, i.e., printing by means of type elements, and dot-matrix printing with a matrix of dots.

Generally, a printing operation by types (hereinafter referred to as "type-printing") provides superior print quality but is low in printing speed. On the other hand, a dot-matrix printing operation is high in printing speed but low in print quality.

In consideration of such circumstances, there have been provided printing apparatuses which are equipped with two printing units or assemblies for performing both type-printing and dot-matrix printing. In such printing apparatuses known in the art, however, the two printing assemblies are selectively moved, as required, into a printing position corresponding to a print line defined on a platen so that a printing is effected by the selected one of the two printing assemblies. Alternatively, the printing assembly at the printing station is changed from one to the other so that the printing is effected by the selected printing assembly. In such arrangements, a selective movement or change of the two printing assemblies for one printing position is extremely troublesome. Further, such printing arrangements of the prior art are incapable of selective printing operation in one of type-printing and dot-matrix printing modes or concurrent printing operations in these two modes at different positions on a sheet of paper.

SUMMARY OF THE INVENTION

It is therefore an object of the present invention to provide a printing apparatus which solves the above indicated problems experienced in the prior art, and which allows type-printing and dot-matrix printing at different positions on a sheet of paper, without requiring troublesome operations of selectively moving one of two printing assemblies to a current printing position, or without changing the printing assemblies from one to the other, so that the functional features of the two different types of printing assemblies are fully utilized for printing characters as clearly and efficiently as possible.

According to the invention, there is provided a printing apparatus having a carrier which reciprocates along a print line defined on a platen, comprising: a first printing assembly supporte on the carrier and having type elements abuttable on the platen for printing characters; and a second printing assembly also supported on the carrier for printing characters by a dot matrix. The first and second printing assemblies have a first and a second print point, respectively, which are spaced from each other in a direction along the surface of the platen.

In the printing apparatus constructed as described above, both type-printing and dot-matrix printing modes of operations can be performed concurrently in different positions on a sheet of paper. For example, when a table is printed (when information to be printed is tabulated), column lines of the table are printed in a dot matrix fashion, i.e., by the second printing assembly, while at the same time, characters within the column lines are printed by type elements of the first printing assembly. This concurrent bi-mode printing operation does not require troublesome operation of selectively moving one of the two printing assemblies to a printing position, or changing the currently active printing assembly from one to the other, as required in the prior printing apparatus of similar type, whereby the features of the two printing assemblies are fully utilized, and the printing may be effected with improved quality and efficiency.

According to one embodiment of the invention, the second print point is spaced away from the first print point in a direction perpendicular to the print line.

According to an alternative embodiment of the invention, the second print point is spaced away from the first print point in a direction parallel to the print line.

In one advantageous embodiment of the invention, a first ribbon cassette and a second ribbon cassette are provided for accommodating a first and a second ribbon for use by the first and second printing assemblies, respectively.

In the above embodiment, the first and second ribbon cassettes may be connected to a common motor by a connecting device which prevents the first ribbon cassette from feeding the first ribbon when only the second printing assembly is operating. In this case, the connecting device may include a first one-way clutch for transmitting only the rotation of the motor in one of forward and reverse directions to the first ribbon cassette, and a second one-way clutch for transmitting only the rotation of the motor in the other direction to the second ribbon cassette.

Alternatively, the first and second ribbon cassettes may be driven by two motors, respectively.

In another advantageous embodiment of the invention, one of the first and second ribbon cassettes is disposed in a plane substantially parallel to an axis of the platen and the other ribbon cassette is disposed in a plane substantially perpendicular to the axis of the platen.

The first and second printing assemblies may use a common ribbon cassette. In this form of the printing apparatus, an exposed portion of a ribbon of said common ribbon cassette outstretched externally thereof may be selectively shifted to the first print point of the first printing assembly, or to the second print point of the second printing assembly, by ribbon operating members. In this instance, it is appreciated that the platen be adapted to be rotatable about its axis and the exposed portion of the ribbon be arranged to extend along the print line. The exposed portion of the ribbon is selectively brought into the first or second print point by the ribbon operating members which are pivotable about the axis of the platen.

In another form of the apparatus wherein the common ribbon cassette is provided, it is possible to arrange such that the ribbon cassette moves the exposed portion of the ribbon so that it is selectively shifted to the first print point of the first printing assembly, or to the second print point of the second printing assembly.

According to another embodiment of the invention, the platen is rotatable about its axis, and the first and second print points are located at substantially diametrically opposite positions of said platen.

According to a further embodiment of the invention, the platen is rotatable about its axis, and paper guides are disposed along a circumferential surface of the platen on both sides of at least one of the first and second print points in a circumferential direction of the platen. The paper guides define an elongate opening extending along a line of reciprocation of the carrier, for permitting a printing operation at said at least one of the first and second print points. Further, a bridging member is provided so as to be located in an operating position at which it covers at least a part of the elongate opening when a sheet of print paper is inserted while being guided by the paper guides, in order to prevent a leading edge of the print paper from passing through the opening to the outside, and so as to be moved to a retreating position in order not to disturb the printing operation.

In one advantageous form of the above embodiment, the bridging member is movable along edges defining both sides of the opening between the paper guides and comprises at least one tape member covering the opening except a part thereof adjacent to said at least one of the first and second print points. The tape member is connected to the printing assembly corresponding to said at least one of the first and second print points, such that said part of the opening not covered with the tape member is moved along the line of reciprocation of the carrier when the tape member is moved along the opening by the movement of the corresponding printing assembly.

In the above advantageous form of the apparatus, the tape member may be provided on both sides of said at least one of the first and second printing assemblies. Each of the tape members is wound in a coil, and adapted to stretch in a line from its outer end of the coil for covering the elongate opening defined by the paper guides.

In another advantageous form of the above embodiment, the bridging member is of comb shape having comb teeth perpendicular to a longitudinal direction of the opening and movable in a direction along the comb teeth. The comb teeth stretch to bridge the opening while the bridging member is in its operating position, but do not bridge the opening while the bridging member is in the retreating position.

According to a still further embodiment of the invention, the first printing assembly comprises a diasy-type type wheel having the type elements at the free ends of multiple spokes, and a hammer located at the back of the type wheel and opposite to the platen so that the type elements are located between the hammer and the platen for striking the type elements against the platen.

In accordance with yet another embodiment of the invention, the second printing assembly comprises a wire-dot type print head having a multiplicity of wires which are selectively activated for printing.

According to one preferred form of the embodiment wherein the second print point is spaced from the first print point in a direction perpendicular to the print line, said platen serves as a main platen rotatable about its axis, and a long generally flat, stationary auxiliary platen is provided adjacent to the circumferential surface of the main platen and extending in an axial direction of the main platen such that a sheet of print paper set along the circumferential surface of the main platen also passes over the auxiliary platen. In this case, one of the first and second printing assemblies is disposed opposite to the main platen, and the other printing assembly is disposed opposite to the auxiliary platen.

BRIEF DESCRIPTION OF THE DRAWINGS

The above and other objects, features and advantages of the present invention will become more apparent from reading the following description of the preferred embodiments taken in connection with the accompanying drawings in which.

DETAILED DESCRIPTION OF THE PREFERRED EMBODIMENTS

Figure 1:
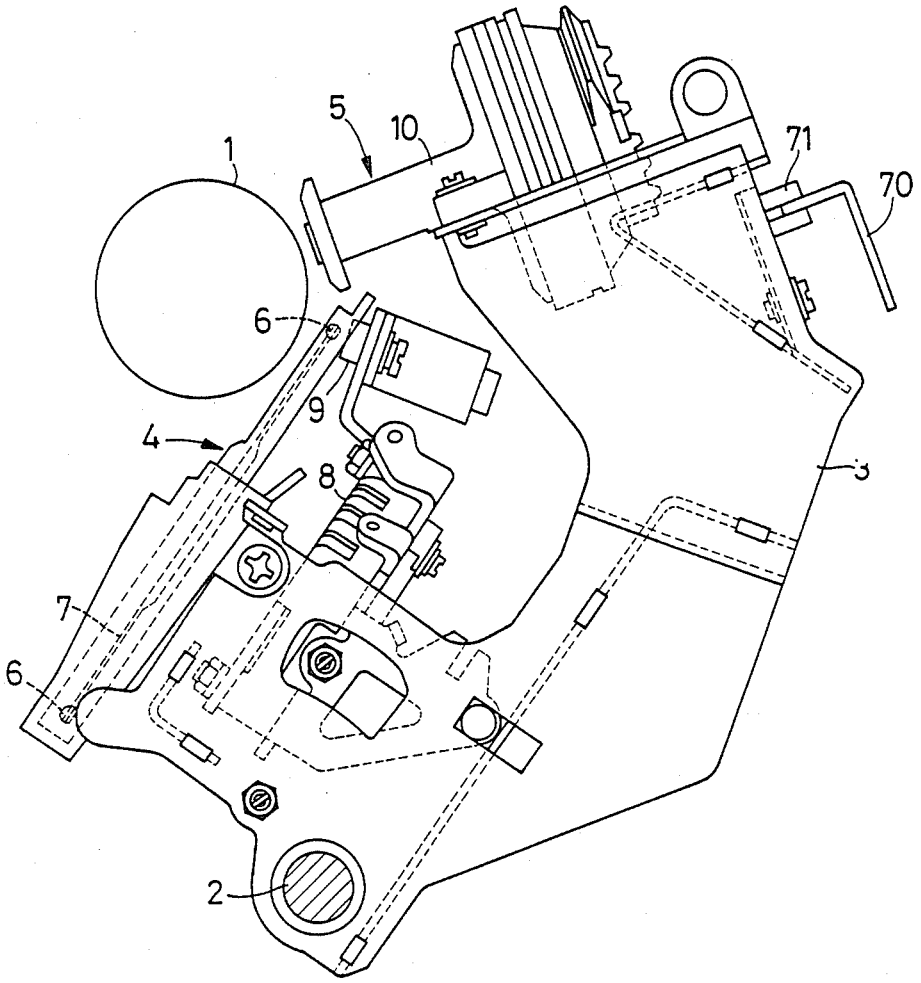
FIG. 1 is a side elevational view of printing assemblies of a first embodiment of a printing apparatus of this invention.

To further clarify the present invention, a first embodiment of a printing apparatus of the invention will be described in greater detail, referring to FIGS. 1–5 of the drawings.

On a frame (not shown) of this embodiment of the printing apparatus, a platen 1 of a circular shape in cross section is rotatably supported. A guide bar 2 and a guide plate 70 are fixed to the frame and disposed parallel to the platen 1. On the guide bar 2 is movably supported a carrier 3 which has a guide 71 slidably engaging the guide plate 70. The carrier 3 is guided by the guide bar 2 and the guide plate 70 so that the carrier 3 is reciprocated along a print line defined on the platen 1. The carrier 3 carries a first printing assembly 4 and a second printing assembly 5, which have different print points.

The first printing assembly 4 is provided with a daisy-type type wheel 7 having a multiplicity of type elements 6 which are held at the free ends of multiple spokes in a plane opposite to the platen 1 so that they are abuttable on the surface of the platen 1. The first printing assembly 4 is further provided with an indexing motor 8 for rotating the type wheel 7 and thereby locating a selected type element 6 in a position corresponding to the print line on the platen 1, and a hammer 9 which is located at the back of the print wheel 7 and opposite to the platen 1 so that the type elements 6 are disposed between the hammer 9 and the platen 1. The hammer 9 strikes the rear surface of the selected type element 6 to print a character (corresponding to the selected type element 6) on a sheet of paper. The second printing assembly 5 is provided with a dot-wire type print head 10 for printing characters on the print paper with a matrix of dots by selective activation of plural print pins or wires (not shown) in a well known manner. In this embodiment, the second printing assembly 5 is disposed so as to have a print point which is spaced from the print point of the first printing assembly 4, in the upward direction (toward the leading edge of the paper sheet) by a distance corresponding to the predetermined number of print lines.

Figure 2:
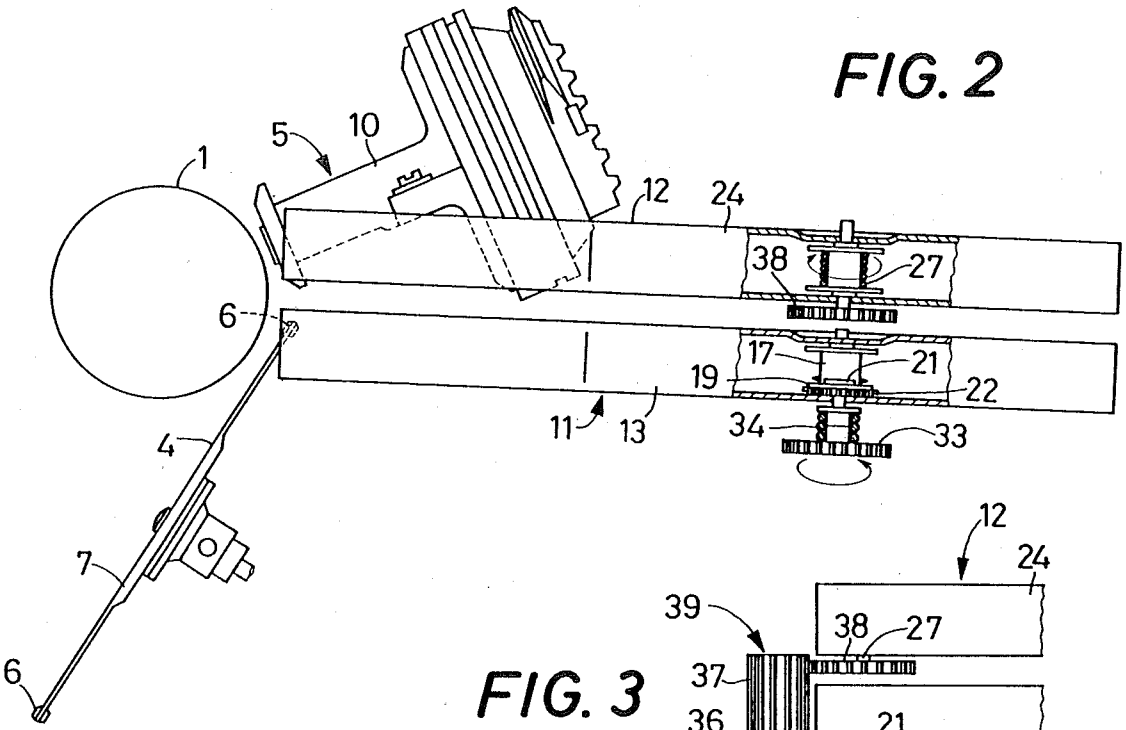
FIG. 2 is a partially-cutaway side elevational view illustrating the relationship between the printing

As shown in FIG. 2, first and second ribbon cassettes 11 and 12 used exclusively for the respective first and second printing assemblies 4 and 5 are removably supported on the carrier 3 at positions corresponding to the respective printing assemblies 4, 5.

Figure 4:
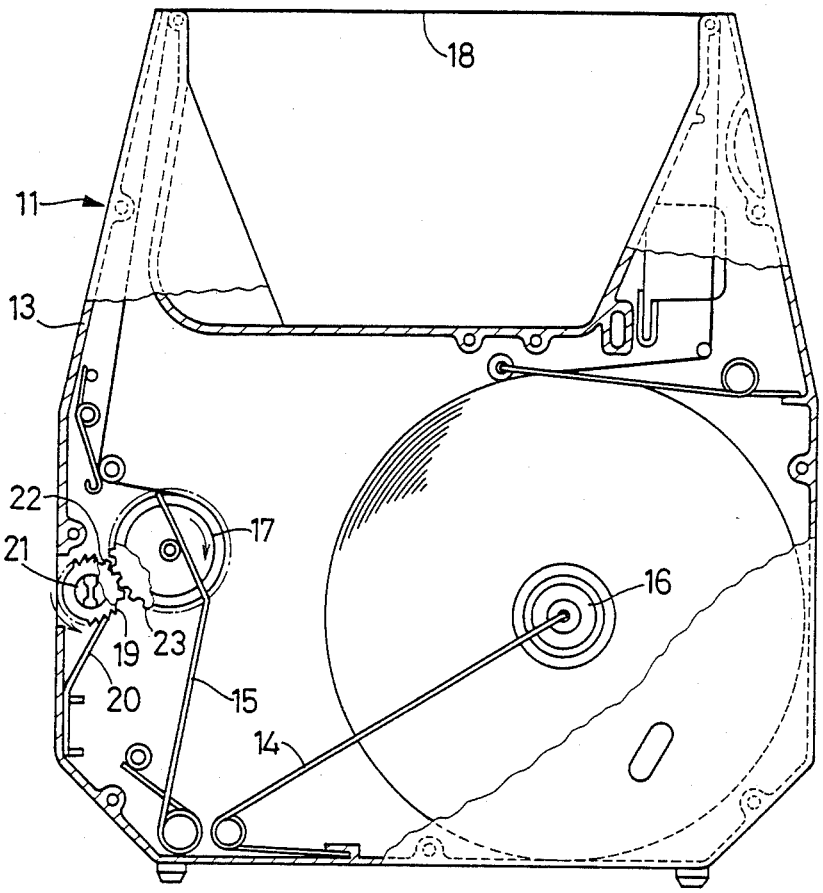
FIG. 4 is a partially-cutaway plan view illustrating the first ribbon cassette.

As shown in FIG. 4, the first ribbon cassette 11 has a supply spool 16 and a take-up spool 17 rotatably supported by wire springs 14 and 15, respectively, inside a cassette casing 13. A carbon ribbon 18 (first ribbon) wound on the supply spool 16 is partly exposed outside the cassette casing 13. The exposed length of the carbon ribbon 18 is fed back into the cassette casing 13 and re-wound on the take-up spool 17 after the exposed portion is used for printing. The carbon ribbon 18 is fed when the take-up spool 17 is rotated in the clockwise direction (as seen in FIG. 4) via gears 22 and 23 by the rotation of a drive shaft 21 which is allowed to rotate only in one direction (counterclockwise direction as viewed in FIG. 4) through engagement of a ratchet wheel 19 with a pawl 20.

Figure 5:
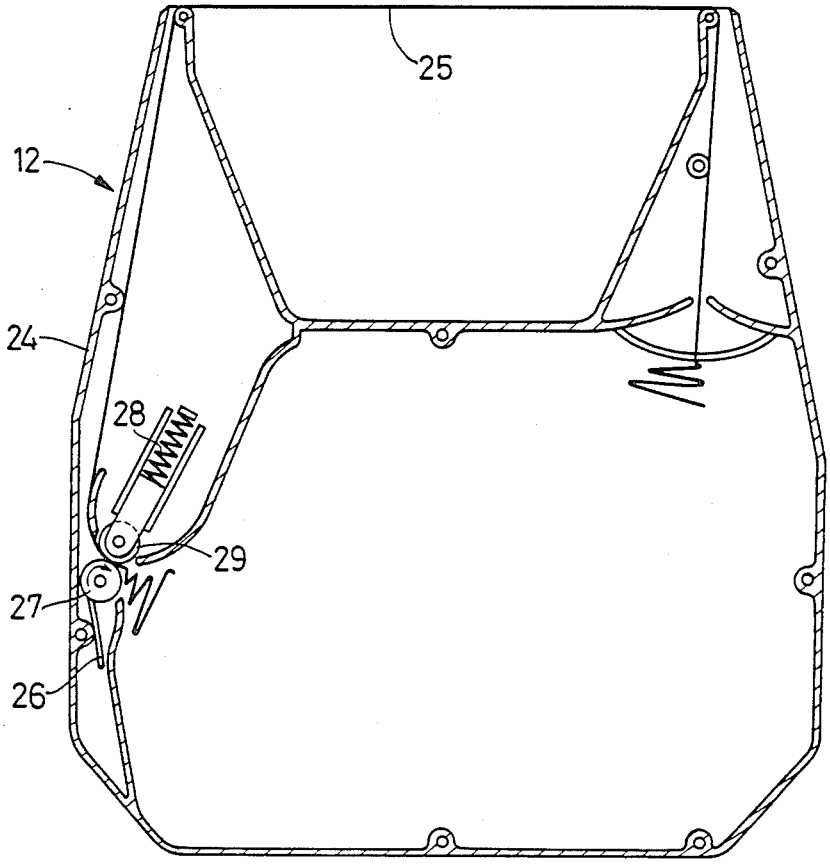
FIG. 5 is a cross sectional view of the second ribbon cassette.

As shown in FIG. 5, the second ribbon cassette 12 has an endless fabric ribbon 25 (second ribbon), a portion of which is outstretched or exposed in the exterior of a cassette casing 24. The fabric ribbon 25 is fed through cooperation of a drive roller 27 and a driven roller 29. The drive roller 27 is permitted to rotate only in one direction (clockwise direction as viewed in FIG. 5) by the engagement of a ratchet wheel (not shown) and a pawl 26. The driven roller 29 is in close contact with the drive roller 27 by the biasing force of a spring 28 and driven by the drive roller 27.

Figure 3:
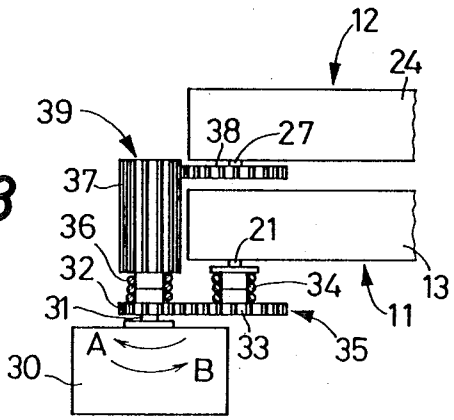
FIG. 3 is a fragmentary elevational view of a ribbon feeder.

As clearly shown in FIGS. 2 and 3, the carrier 3 carries a motor 30 acting as a common drive source for feeding the ribbons 18 and 25 of the ribbon cassettes 11 and 12. Between a motor shaft 31 of the motor 30 and a drive shaft 21 of the first ribbon cassette 11, there is provided a first connecting mechanism 35 comprising gears 32, 33 and a first spring clutch 34 which is a kind of one-way clutch. Only when the motor shaft 31 is rotated in a direction A indicated by arrow in FIG. 3, the first spring clutch 34 operates to rotate the drive shaft 21 in the counterclockwise direction (in FIG. 4), thereby feeding the carbon ribbon 18. Between the motor shaft 31 and the drive roller 27 of the second ribbon cassette 12, there is provided a second connecting mechanism 39 comprising a second spring clutch 36 and gears 37, 38. The second spring clutch 36 also serves as a one-way clutch. That is, only when the motor shaft 31 is rotated in a direction B shown by arrow in FIG. 3, the second spring clutch 36 operates to rotate the drive roller 27 in the clockwise direction (in FIG. 5), thereby feeding the fabric ribbon 25. The first and second connecting mechanisms 35, 39 constitute a connecting device which connects the first and second ribbon cassettes 11, 12 to their common drive motor 30.

Accordingly, in the printing apparatus of this first embodiment, when print signals are selectively input to the first and second printing assemblies 4 and 5 with a sheet of paper held on the platen 1, the printing assemblies 4, 5 are selectively operated to perform printing operations by the type elements 6 and the dot-matrix print wires, at different positions on the print paper, in proper combination. For example, column lines of a table or chart are printed by the dot-matrix print wires of the second printing assembly 5, while desired characters are printed in the table (within the column lines) by the type elements 6 of the first printing assembly 4. Therefore, the table or chart can be prepared in enhanced printing quality and at increased speeds.

In the above described embodiment wherein the exclusive ribbon cassettes 11 and 12 are provided for use by the first and second printing assemblies 4 and 5, respectively, the suitable kind of ribbon, i.e., carbon ribbon 18 or fabric ribbon 25 is selected to meet the specific printing requirement, whereby improved printing quality is easily obtained. Although this embodiment is of a simple configuration provided with only one motor 30 serving as a drive source for feeding the ribbons 18, 25, a wasteful feeding motion of the disposable carbon ribbon 18 of the one-time ribbon cassette 11 is prevented, particularly when the second printing assembly 5 is operated. More specifically, the carbon ribbon 18 is effectively utilized because when the first printing assembly 4 is operated, the motor 30 is rotated in the direction A (shown by arrow in FIG. 3) to feed only the carbon ribbon 18 of the first ribbon cassette 11, and when the second printing assembly 5 is operated the motor 30 is rotated in the direction B (shown by arrow in FIG. 3) to feed the fabric ribbon 25 of the second ribbon cassette 12.

In the foregoing embodiment, for example, the connection of the first ribbon cassette 11 to the motor 30 via disconnecting means such as an electromagnetic clutch, and the connection of the second ribbon cassette 12 directly to the motor 30, i.e., without connecting them via disconnecting means, allow the fabric ribbon 25 of the second ribbon cassette 12 to be always fed while the motor 30 is rotated, and the carbon ribbon 18 of the first ribbon cassette 11 to be fed only while the first printing assembly 4 is operated.

Figure 6:
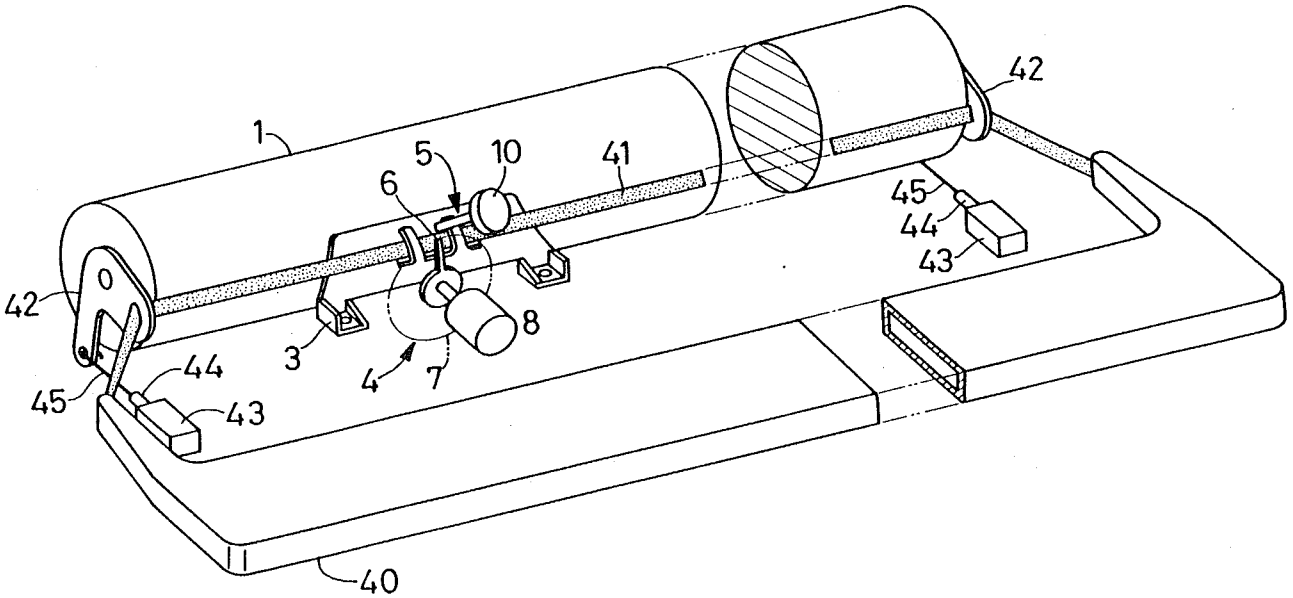
FIG. 6 is a perspective view of a second embodiment of the invention, showing particularly the relationship between the printing assemblies and a print ribbon.

Referring next to FIG. 6, a second embodiment of the invention will be described in greater detail. This alternative embodiment is different from the foregoing embodiment in the arrangement of a print ribbon for the first and second printing assemblies 4 and 5.

Namely, a ribbon cassette 40 is removably supported on the frame so as to correspond to the overall distance of movement of the carrier 3, and a portion of an endless fabric ribbon 41 is outstretched externally of the ribbon cassette 40, on the side of the platen 1, as an exposed portion. On both sides of the platen 1, ribbon operating members 42 are supported pivotally about an axis of rotation of the platen 1. Between front end portions of the ribbon operating members 42, the exposed portion of the fabric ribbon 41 is disposed to extend between the printing assemblies 4, 5 and the platen 1.

Corresponding to the two ribbon operating members 42, solenoids 43 are disposed, on the frame. Plungers 44 of the solenoids 43 are connected to the ribbon operating members 42 via wires 45, respectively. The ribbon operating members 42 are pivoted to the operating positions of the printing assemblies 4, 5 by the operation of these solenoids 43, whereby the exposed portion of the ribbon 41 is selectively shifted to the first print point of the first printing assembly 4, or to the second print point of the second printing assembly 5.

Subsequently, in the printing apparatus of this second embodiment, when print signals are selectively transferred to the first and second printing assemblies 4 and 5, with a print paper held on the platen 1, the solenoids 43 are first activated to shift the ribbon 41 to the print point of the selected printing assembly 4 or 5 by the pivotal motion of the ribbon operating members 42. The selected printing assembly 4 or 5 is then operated to effect the printing operations at different positions on the paper by the type elements 6 or dot matrix. As described above, although this embodiment has an extremely simplified ribbon cassette arrangement, printing can be performed with enhanced printing result and at high speed, as in the preceding embodiment, through selective activation of the printing assemblies 4 and 5.

While the ribbon 41 is shifted to the print point of the first or second printing assembly 4 or 5 by the pivotal motion of the ribbon operating members 42 in the above embodiment, it is also possible that the selective shifting of the ribbon 41 to the print point of the first or second printing assembly 4 or 5 be accomplished by movement of the ribbon cassette 40.

Referring further to FIGS. 7–12, a third embodiment of the invention will be described in detail. This embodiment is different from the foregoing first embodiment in the arrangement of the first and second printing assemblies 4, 5.

Figure 7:
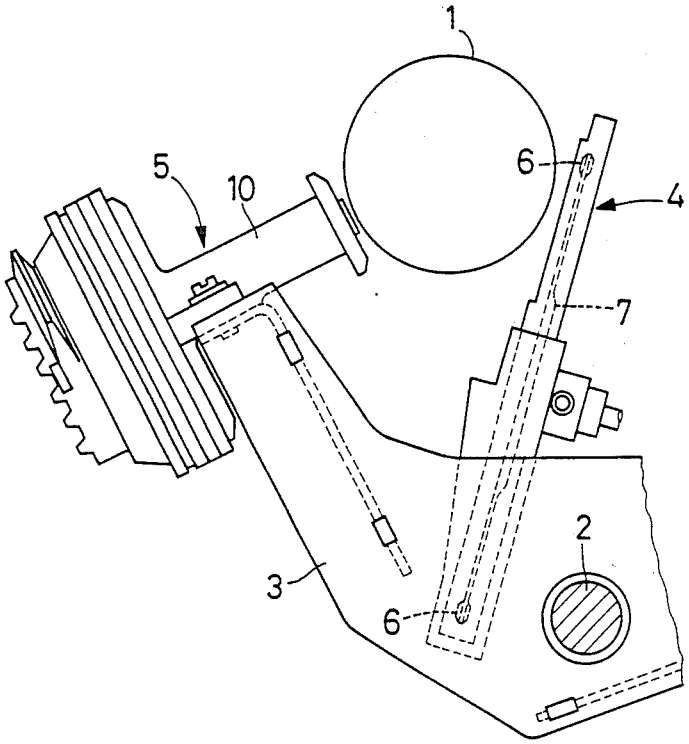
FIG. 7 is a fragmentary side elevational view of the printing assemblies of a third embodiment of the printing apparatus.
Figure 8:
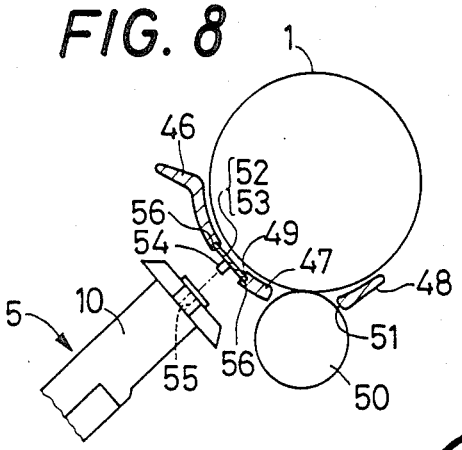
FIG. 8 is a fragmentary elevational view partly in cross section of a paper guide arrangement.

As shown in FIG. 7, the third embodiment of the printing apparatus is adapted so that the second printing assembly 5 is disposed on the paper inserting side of the platen 1, i.e., on the side opposite to the first printing assembly 4, with the platen 1 located therebetween. More specifically stated, the first and second print points of the first and second printing assemblies 4 and 5 are located at substantially diametrically opposite positions of the platen 1. That is, the first and second print points are spaced from each other in a direction perpendicular to the print line, i.e., spaced circumferentially of the platen 1 by a distance corresponding to a predetermined number of lines in a feeding direction of the paper. Since the second printing assembly 5 is disposed on the paper inserting side of the platen 1, it is required to divide a paper guide assembly into separate guides 46, 47 and 48 as shown in FIG. 8, which are disposed and spaced from each other along the circumferential surface of the platen 1, to provide two elongate openings 49 and 51 for the purposes which will be described. The paper guides 46 and 47 define the elongate opening 49 extending along a line of reciprocation of the carrier 3, for permitting a front end portion of the print head 10 of the second printing assembly 5 to perform a printing operation through that elongate opening 49. Further, the paper guides 47 and 48 define the elongate opening 51 similar to the opening 49, to permit a presser roller 50 to contact the circumferential surface of the platen 1. Because of the presence of the elongate opening 49 between the two paper guides 47 and 48, the leading edge of the paper sheet may pass through the elongate opening 49 when the paper sheet is inserted between the paper guide 46 and the platen 1 while being guided by the paper guide 46. In other words, there is a possibility that the leading portion of the sheet is not properly directed to the paper guide 48 which functions to guide the sheet to the nip of the presser roller 50 and the platen 1.

Figure 9:
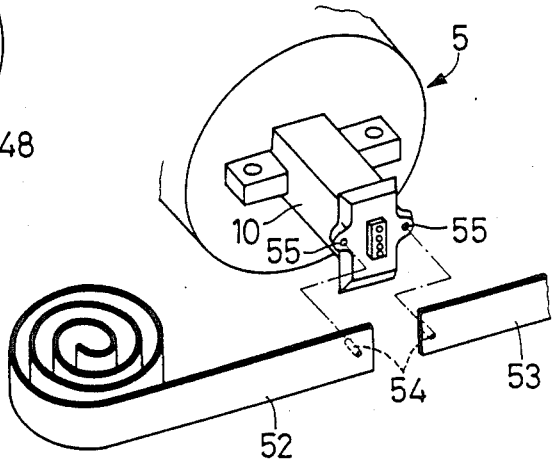
FIG. 9 is a fragmentary persepective view of the paper guide arrangement of FIG. 8.

In order to eliminate the above indicated possibility, a bridging member is provided. When the bridging member is located at its operating position, it covers at least a part of the elongate opening 49 to prevent the passage of the leading portion of the inserted paper through the elongate opening 49. The bridging member is movable to its retreating position so as not to disturb the printing operation by the second printing assembly 5. For this purpose, tape members 52 and 53 of coil type as shown in FIG. 8 and 9 are disposed on the frame at opposite ends of a moving range of the carrier 3, respectively. These tape members 52, 53 are wound in a coil and their leading portions on the outer side of the coil are stretched in lines so that the leading ends are fixed to both sides of the front end portion of the print head 10 through engagement of pins 54 and apertures 55, respectively. The linearly stretched leading portions of the tape members 52, 53 are moved along the platen 1 by the reciprocating movements of the print head 10, while those leading portions are slidably engaged in guide grooves 56 formed in the edges of the paper guides 46 and 47 that define the elongate opening 49. Thus, the opening 49 is closed or covered by the tape members 52, 53, except a part thereof adjacent to the front end portion of the print head 10, whereby the sheet of paper is properly inserted and guided through a clearance between the platen 1 and the paper guide 47.

Figure 10:
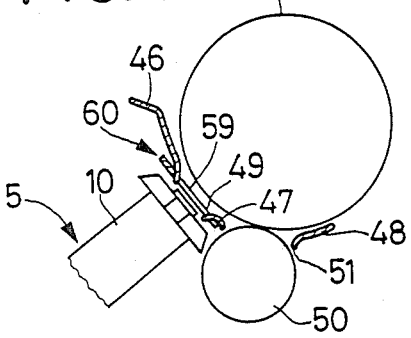
FIG. 10 is a fragmentary elevational view partly in cross section of another form of a paper guide arrangement.
Figure 12:
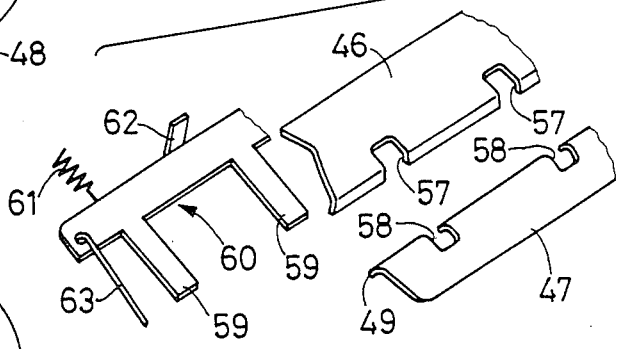
FIG. 12 is a fragmentary perspective view of the paper guide arrangement of FIG. 10.
Figure 11:
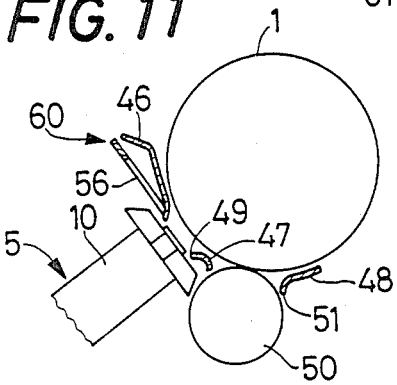
FIG. 11 is a fragmentary elevational view partly in cross section, illustrating an operating state of the paper guide arrangement of FIG. 10.
Figure 13:
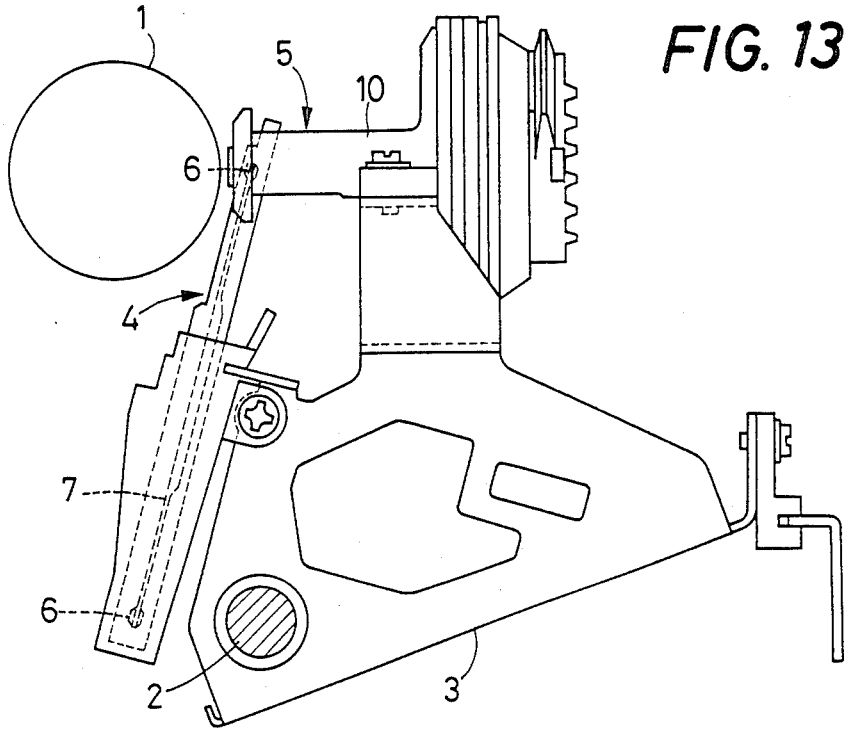
FIG. 13 is a side elevational view of printing assemblies in a fourth embodiment of the printing apparatus of the invention.
Figure 14:
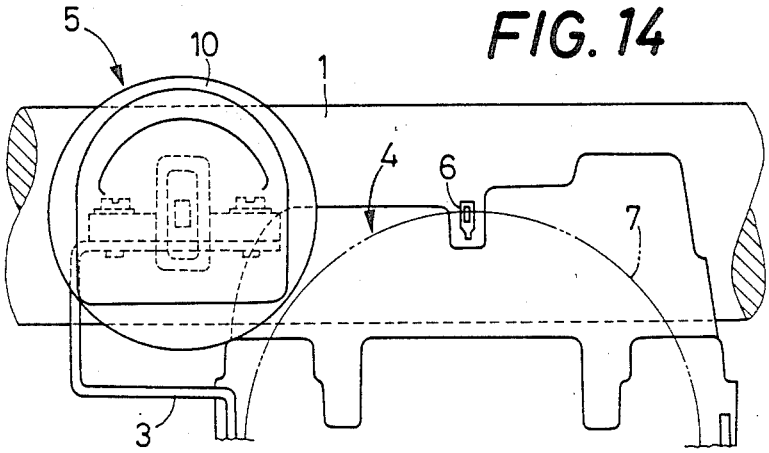
FIG. 14 is a fragmentary elevational view of the printing assemblies of FIG. 13.
Figure 15:
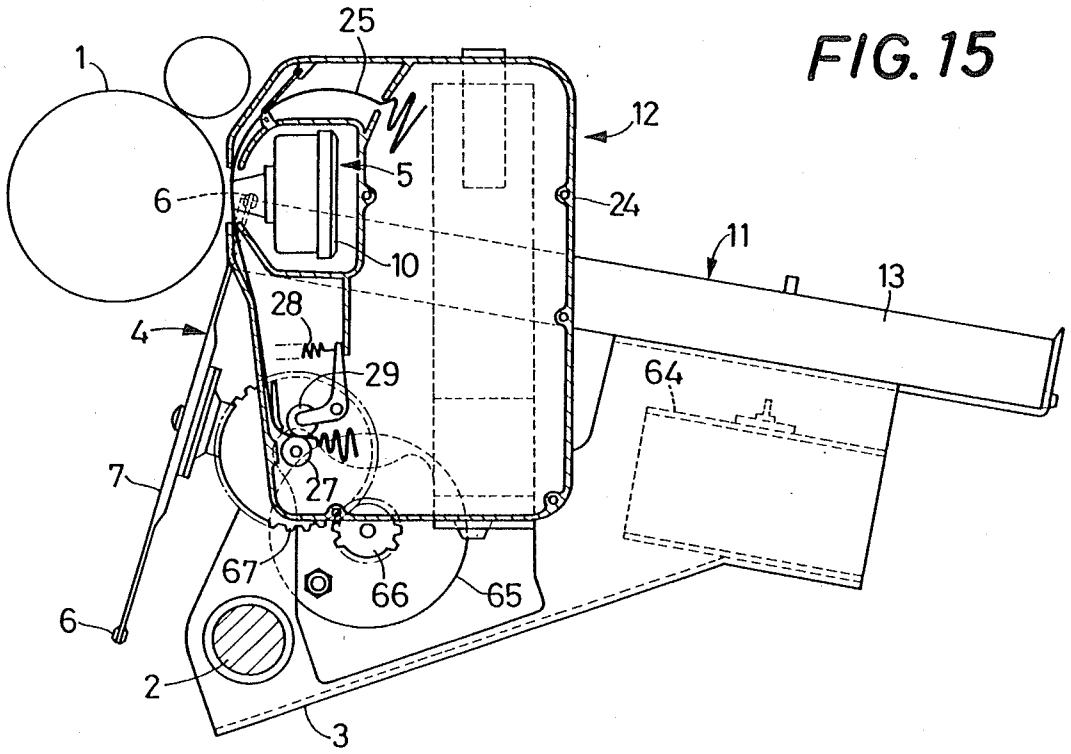
FIG. 15 is a side elevational view in cross section, showing the relationship between the printing assemblies and the ribbon cassettes.
Figure 16:
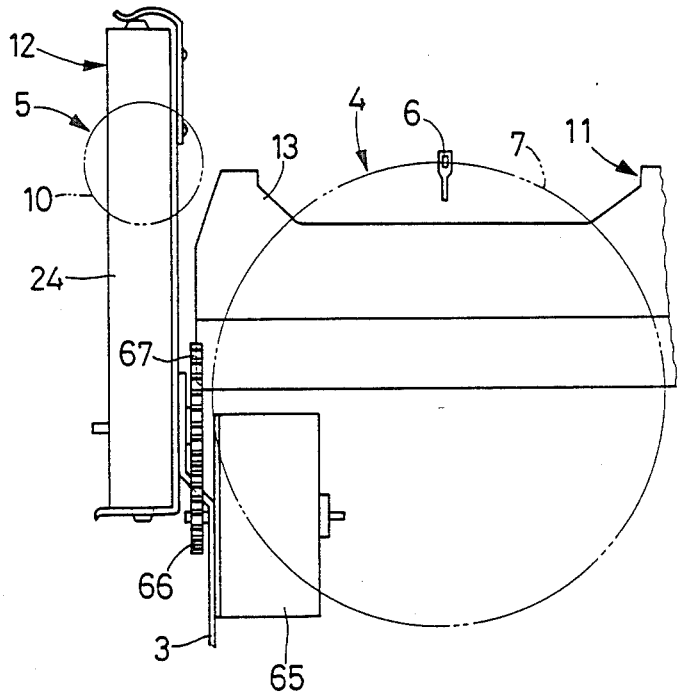
FIG. 16 is a fragmentary front elevational view of the printing assemblies of FIG. 15.

An alternative form of the bridging member is shown in FIGS. 10–12, wherein a comb-shaped cover body 60 has a multiplicity of comb teeth 59, which are engageable with corresponding multiple recesses 57 and 58 formed in the paper guides 46 and 47, respectively. The cover body 60 is movable between the paper guide 46 and the print head 10 in a direction perpendicular to the length of the elongate opening 49. The cover body 60 is normally retained in its retreating position at which it engages with stoppers 62 located on the frame (not shown), by the biasing force of springs 61 as shown in FIG. 12, so that the opening 49 between the paper guides 46 and 47 is open. When the sheet of paper is inserted, the cover body 60 is moved to its operating position by suitable actuators (not shown) such as solenoids, via wires 63, so that the opening 49 is partially covered or closed at predetermined intervals with the comb teeth 59 bridging the opening 49. Accordingly, this modified form of the bridging member 60 assures smooth insertion of the paper sheet without passing through the opening 49.

A fourth embodiment of the printing apparatus of the present invention is shown in FIGS. 13–16, which differs from the first embodiment in the arrangement of the first and second printing assemblies 4, 5.

In this modified embodiment, the second printing assembly 5 is disposed so that its second print point is located in the print line on which the first print point of the first printing assembly 4 is located. More particularly stated, the first and second printing assemblies 4 and 5 are disposed so that the second print point of the assembly 5 is spaced leftwardly from the first print point of the assembly 4 in a direction parallel to the line of printing, by a distance corresponding to a predetermined number of characters. Further, the first ribbon cassette 11 for the first printing assembly 4 of this embodiment is disposed in a plane substantially parallel to the axis of the platen 1 and slightly inclined from the horizontal plane, and the second ribbon cassette 12 for the second printing assembly 5 is disposed upright, i.e., in a plane substantially perpendicular to the axis of the platen 1. On the carrier 3, there are provided ribbon feeding motors 64, 65 exclusively used for the ribbon cassettes 11 and 12, respectively. When the first printing assembly 4 performs a printing operation, a drive shaft of the first ribbon cassette 11 is rotated by the first motor 64, via a gear transmission mechanism (not shown) or the like to feed the carbon ribbon 18. When the second printing assembly 5 performs a printing operation, the drive roller 27 of the second ribbon cassette 12 is rotated by the second motor 65 via gears 66 and 67 to feed the fabric ribbon 25.

Thus, in the above embodiment, printing can be simultaneously or selectively performed by the type elements 6 and the dot matrix, at different positions on the same print line, by the first and second printing assemblies 4 and 5, respectively.

While the present invention has been described in its preferred embodiments, it is to be understood that the invention is not limited thereto, but various changes and modifications may be made to the invention without departing from the spirit and scope of the invention. For example, it is possible to replace the first and second printing assemblies 4, 5 by other arrangements such as a ball-type print head and a thermal print head. Further, it is appreciated that a long generally flat, stationary auxiliary platen be provided adjacent to the circumferential surface of the rotatable main platen 1 of circular cross section. Such an auxiliary platen extends in an axial direction of the main platen 1 such that the sheet of paper set along the surface of the main platen 1 also passes over the auxiliary platen. In this case, one of the first and second printing assemblies 4, 5 is disposed opposite to the main platen 1, and the other is disposed opposite to the auxiliary platen.

What is claimed is:

1. A printing apparatus comprising:

first printing means for type-printing characters including a daisy-type wheel having type elements which are disposed at the free ends of multiple spokes and abuttable on a platen, and a hammer located at the back of said daisy-type wheel and opposite to said platen so that said type elements are selectively located between said hammer and said platen for striking said type elements against said platen;

second printing means including a plurality of print elements which are selectively activated for printing characters by a dot matrix;

a single common carrier which reciprocates along a print line defined on said platen, said first and second printing means being supported on said single common carrier and said second printing means having a second print point which is spaced away from a first print point of said daisy-type wheel of said first printing means in a direction along the surface of said platen parallel to said print line;

a first ribbon cassette accommodating a first ribbon for use by said first printing means, said first ribbon cassette being disposed in a plane substantially parallel to said print line;

a second ribbon cassette accommodating a second ribbon for use by said second printing means, said second ribbon cassette being disposed in a plane substantially perpendicular to said print line; and means for controlling said first and second printing means, said single common carrier, and said first and second ribbon cassettes to effect a mixed type and dot matrix printing in the same line of printing.

2. A printing apparatus as recited in claim 1, wherein said first and second ribbon cassettes are connected to a common ribbon feed motor by a connecting device which prevents said first ribbon cassette from feeding said first ribbon when only the second printing means is operating.

3. A printing apparatus as recited in claim 2, wherein said motor is rotatable in both forward and reverse directions, and said connecting device includes first one-way clutch means for transmitting only the rotation of said motor in one of said forward and reverse directions to said first ribbon cassette, and second one-way clutch means for transmitting only the rotation of said motor in the other direction to said second ribbon cassette.

4. A printing apparatus as recited in claim 4, wherein said first and second ribbon cassettes are each driven by a separate motor.

5. A printing apparatus as recited in claim 1, wherein said second printing means comprises a wire-dot type print head having a multiplicity of wires which are selectively activated for printing.

* * * * *